US008365978B2

(12) United States Patent
Yoshimura et al.

(10) Patent No.: US 8,365,978 B2
(45) Date of Patent: Feb. 5, 2013

(54) TONGUE-LID PACKAGE

(75) Inventors: Kazuhiro Yoshimura, Tokyo (JP); Hiroko Murai, Tokyo (JP); Hidehisa Tokita, Tokyo (JP); Masahiro Fukui, Tokyo (JP); Akihiro Saito, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 121 days.

(21) Appl. No.: 12/953,768

(22) Filed: Nov. 24, 2010

(65) Prior Publication Data

US 2011/0068155 A1 Mar. 24, 2011

Related U.S. Application Data

(63) Continuation of application No. PCT/JP2009/060020, filed on Jun. 2, 2009.

(30) Foreign Application Priority Data

Jun. 6, 2008 (JP) ..... 2008-149237

(51) Int. Cl.
*B65D 65/28* (2006.01)
*B65D 85/10* (2006.01)

(52) U.S. Cl. ..... 229/87.05; 206/264; 206/273; 206/274; 229/87.13

(58) Field of Classification Search ..... 229/87.05, 229/87.13, 164.1; 206/264, 268, 271, 273, 206/274

See application file for complete search history.

(56) References Cited

U.S. PATENT DOCUMENTS

| | | | | |
|---|---|---|---|---|
| 1,291,984 | A * | 1/1919 | Maloney | 229/87.05 |
| 4,300,676 | A * | 11/1981 | Focke et al. | 206/264 |
| 4,303,155 | A | 12/1981 | Focke et al. | |
| 4,550,826 | A * | 11/1985 | Asanuma | 206/273 |
| 4,807,745 | A | 2/1989 | Langley et al. | |
| 6,164,444 | A * | 12/2000 | Bray et al. | 206/268 |
| 6,199,687 | B1 | 3/2001 | Tambo et al. | |
| 6,478,149 | B1 * | 11/2002 | Parker | 206/273 |
| 2005/0241967 | A1 | 11/2005 | Sendo | |
| 2006/0249408 | A1 * | 11/2006 | Tambo | 206/264 |
| 2008/0006544 | A1 * | 1/2008 | Bouno et al. | 206/268 |
| 2008/0047852 | A1 * | 2/2008 | Ghini et al. | 206/268 |
| 2009/0071101 | A1 * | 3/2009 | Bertuzzi et al. | 206/271 |

FOREIGN PATENT DOCUMENTS

| | | | |
|---|---|---|---|
| EP | 0 007 423 | A1 | 2/1980 |
| EP | 1 588 633 | A1 | 10/2005 |
| JP | 55-20188 | A | 2/1980 |
| JP | 1-166945 | A | 6/1989 |
| JP | 11-49134 | A | 2/1999 |
| JP | 2000-509681 | T | 8/2000 |
| WO | WO 97/42098 | A1 | 11/1997 |
| WO | WO 98/22367 | A1 | 5/1998 |
| WO | WO 2004/064550 | A1 | 8/2004 |

* cited by examiner

*Primary Examiner* — Gary Elkins
(74) *Attorney, Agent, or Firm* — Birch, Stewart, Kolasch & Birch, LLP

(57) ABSTRACT

A package (2) comprises a box body (4) with an open end (22) at the top, a tongue-lid (6) adapted to close the open end (22), rotatably connected to a rear edge of the open end (22) by a lid hinge (30), and an inner pack (8) enclosed in the box body (4). The inner pack (8) includes an envelope (13) enclosing tobacco items (10) and keeping the inner pack (8) airtight.

4 Claims, 6 Drawing Sheets

TONGUE-LID PACKAGE

CROSS REFERENCE TO RELATED APPLICATIONS

This application is a Continuation of PCT International Application No. PCT/JP2009/060020 filed on Jun. 2, 2009, which claims the benefit of patent application No. 2008-149237 filed in Japan, on Jun. 6, 2008. The entire contents of all of the above applications is hereby incorporated by reference into the present application.

TECHNICAL FIELD

This invention relates to a package, more specifically a tongue-lid package.

BACKGROUND ART

A variety of packaging containers for holding an article have been developed in consideration of the features of the article to be held. As a packaging container for tobacco items, such as filtered cigarettes, cigarettes, etc., a tongue-lid package is known.

As one form of the tongue-lid package, there is proposed a tongue-lid package disclosed in patent document 1, for example.

Conventionally-known tongue-lid packages comprise a box with an open end, a tongue-lid for closing the open end of the box, and an article enclosed in the box. The article consists of a bunch of rod-shaped smoking items and a wrapper covering the bunch. Commonly, the package of this type is further wrapped in a transparent film, where the film wrap is provided with a tear-open tape.

PRIOR-ART DOCUMENT

Patent Document

Patent document 1: Japanese Patent Application laid-open No. Hei 11-49134

DISCLOSURE OF THE INVENTION

Problem to be Solved by the Invention

It is preferable to omit film-wrapping the package in view of recent demands for resource saving.

The film wrap is, however, provided to seal the package to prevent the package contents from being affected by ambient air, for example moisture, odors, etc. contained in the ambient air. Thus, omission of the film wrapping may lead to quality deterioration of the package contents.

The present invention has been made in consideration of the problems described above. An object of the present invention is to provide a tongue-lid package allowing omission of film wrapping.

Means for Solving the Problem

In order to achieve the above object, a tongue-lid package according to the present invention comprises a cuboidal box body with an open end at the top, a tongue-lid rotatably connected to a rear edge of the open end by a lid hinge, the tongue-lid including a lid adapted to close the open end and a tongue connected to a distal end of the lid by a tongue hinge, and arranged such that the tongue overlies a front wall of the box body when the lid is in position to close the open end, and a cuboidal inner pack enclosed in the box body, wherein the inner pack includes an article, and an envelope formed by folding a wrapper to enclose the article, the envelope having seams formed by joining edges of the wrapper together to keep the inner pack airtight.

As stated above, the inner pack is formed by folding the wrapper into an envelope enclosing the article, where edges of the wrapper are joined together to keep the inner pack airtight. The inner pack thus formed has high airtightness.

The seams may include a transverse seam formed by joining upper and lower edges of the wrapper together, the transverse seam extending across the width of the inner pack on a front or rear face of the inner pack, and a pair of vertical seams each formed by folding and joining a lateral edge of the wrapper to itself, the vertical seams extending on opposite side faces of the inner pack, respectively.

The transverse seam and the vertical seams are, desirably, each in the form of a fin seal, desirably formed by heat-sealing.

The inner pack with the transverse seam and vertical seams formed as fin seals by heat-sealing is easy to make, which can lead to improved efficiency of article packaging. Further, the thermal influence on the article inside in heat-sealing can be reduced by adopting the fin seal structure for seams.

The tongue-lid package according to the present invention may further comprise an opening production means for enabling production of an access opening for allowing exposure of the article, when the tongue-lid is first opened, the access opening extending from an upper position on the front wall of the box body, across a top face of the inner pack, up to a rear edge of the top face of the inner pack adjacent to said lid hinge.

The opening production means facilitates the production of the access opening, and thus enhances the ease of opening the inner pack.

Effect of the Invention

In the tongue-lid package according to the present invention, the inner pack has high airtightness, so that the quality deterioration of the article inside is suppressed. This allows omission of film-wrapping the package, and thus contributes to resource saving.

BEST MODE OF CARRYING OUT THE INVENTION

Figure 1:
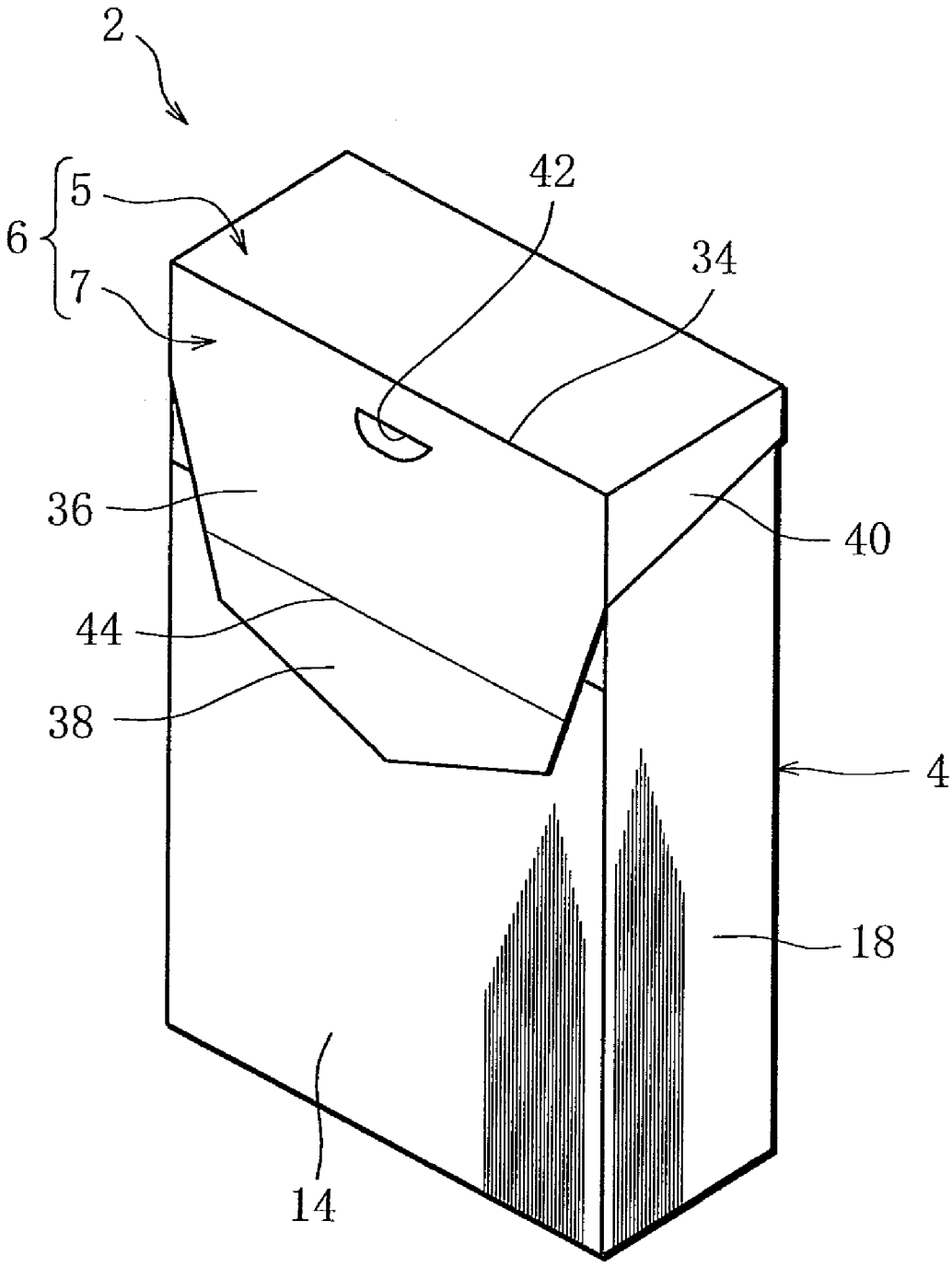
FIG. 1 is a perspective view showing a tongue-lid package according to an embodiment of the present invention before opened.

FIG. 1 shows a package 2 according to an embodiment of the present invention.

The package 2 is a packaging container for holding tobacco items, such as filtered cigarettes or cigarettes, and as a whole, cuboidal in shape.

The package 2 comprises a box body 4 and a tongue-lid 6 connected to the box body 4. The tongue-lid 6 comprises a lid 5 and a tongue 7.

Figure 2:
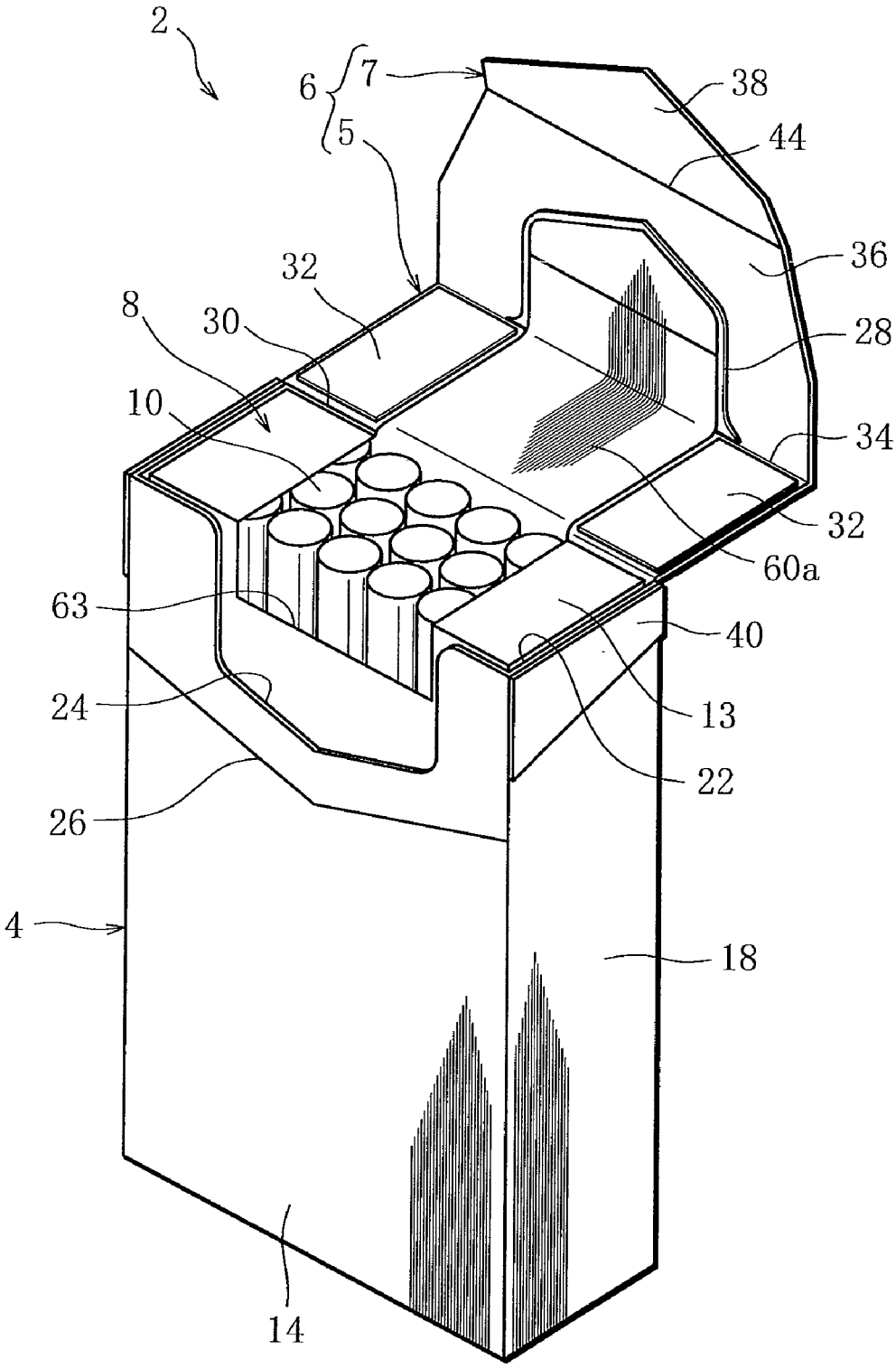
FIG. 2 is a perspective view showing the package of FIG. 1 in an open position.

As seen in FIG. 2, the box body 4 is a cuboid with an open end 22 at the top, and has an interior space of a size suited to receive one inner pack 8. Specifically, the box body 4 comprises a front wall 14, a rear wall 16, a pair of side walls 18 and a bottom wall 20.

As clear from FIG. 2, the front wall 14 has a cutout 24 in an upper middle region. The cutout 24 connects to the open end 22. The cutout 24 is approximately rectangular in shape, only a lower edge bending like a flattened V. The front wall also has a slit 26. The slit 26 is located below the cutout 24. The slit 26 extends from one lateral edge to the other of the front wall 14, along the lower edge of the cutout 24, and thus bends like a flattened V, similarly to the cutout 24. The cutout 24 is formed by separation of a separation piece 28 of the shape corresponding to the cutout 24 from the front wall 14, which is caused when the tongue-lid 6 is first opened. Thus, the package 2 immediately after manufacture has a to-be-separated section delimited by a separation line to form the separation piece 28, in the upper middle region of the front wall 14. The separation line consists of a series of holes, for example, where the adjacent holes may be equal or different in length. The to-be-separated section can be easily separated from the front wall 14 along the separation line.

Figure 3:
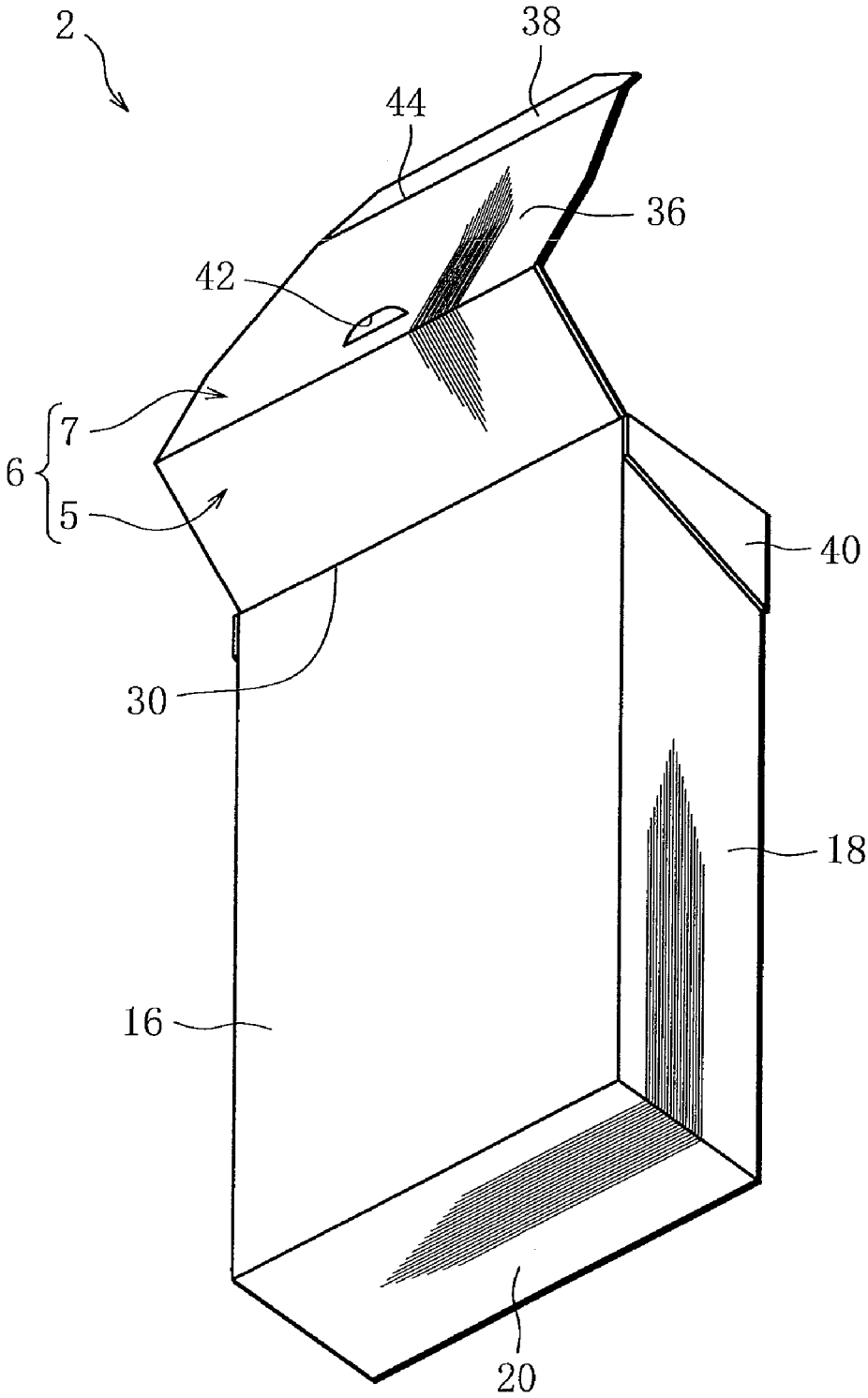
FIG. 3 is a perspective view showing the package of FIG. 1 in an open position, as viewed from the rear bottom side.

As clear from FIG. 3, the rear wall 16 has an upper edge functioning as a lid hinge 30. The tongue-lid 6 is rotatably connected to the rear wall 16 by the lid hinge 30. By the tongue-lid 6 rotating on the lid hinge 30, the open end 22 of the box body 4 is exposed or covered with the lid 5 of the tongue-lid 6. With the lid 5 covering the open end 22, the tongue 7 of the tongue-lid 6 overlies the front wall 14.

More specifically, as clear from FIG. 2, the lid 5 is a rectangular shape of the same size as the open end 22, and provided with rectangular inner top flaps 32 bonded to the inner surface of the lid 5 on either side. Each inner top flap 32 is separably connected to the upper edge of the corresponding side wall 18 by a separation line. In the package 2 immediately after manufacture, the inner top flaps 32, bonded to the inner surface of the lid 5, overlie the top of the inner pack 8 on either side. When the tongue-lid 6 is first opened, each inner top flap 32 is separated from the corresponding side wall 18 along the separation line, being held on the inner surface of the lid 5. These inner top flaps 32 reinforce the lid 5 and improve formability of the box body 4.

The lid 5 and the tongue 7 are connected by a tongue hinge 34.

More specifically, the tongue 7 comprises a tongue section 36 and an insertion end section 38. The tongue section 36 has a size enough to cover the cutout 24 and the to-be-separated section of the front wall 14. More specifically, the tongue section 36 is a trapezoidal shape tapering towards the distal end, and rotatably connected to the front edge of the lid 5 by a tongue hinge 34. As clear from FIG. 1, the tongue section 36 has a semicircular recess 42 in the widthwise center, near the tongue hinge 34. The inner surface of the tongue section 36 has therefore a protrusion corresponding to the recess 42.

As seen in FIG. 1, the insertion end section 38 and the tongue section 36 are delimited by a hinge 44, so that the insertion end section 38 is rotatable on the hinge 44. The insertion end section 38 comprises a proximal portion extending from the distal end of the tongue section 36 and a triangular distal portion continuing from the proximal portion. Each lateral edge of the proximal portion of the insertion end section 38 follows the corresponding lateral edge of a distal portion of the tongue section 36 in a line, so that the tongue 7 as a whole has a shape tapering toward the distal end, which makes it easy to insert the insertion end section 38 into the aforementioned slit 26 of the box body 4.

In the package 2 being manufactured, reinforcement members 40 are connected to the lateral edges of a proximal portion of the tongue section 36, respectively, by a separation line. Each reinforcement member 40 is in the shape of a truncated right triangle. In the package 2 immediately after manufacture, each reinforcement member 40 is bonded to the corresponding side wall 18 of the box body 4 to overlie an upper part of the side wall 18. When the tongue-lid 6 is first opened, each reinforcement member 40 is separated from the tongue section 36 along the separation line to stay on the upper part of the side wall 18. The reinforcement members thus reinforce the open end 22, and keep the tongue 7 in close contact with the front wall 14 of the box body 4, thus offering improved airtightness of the package until the tongue lid 6 is first opened after manufacture.

Figure 4:
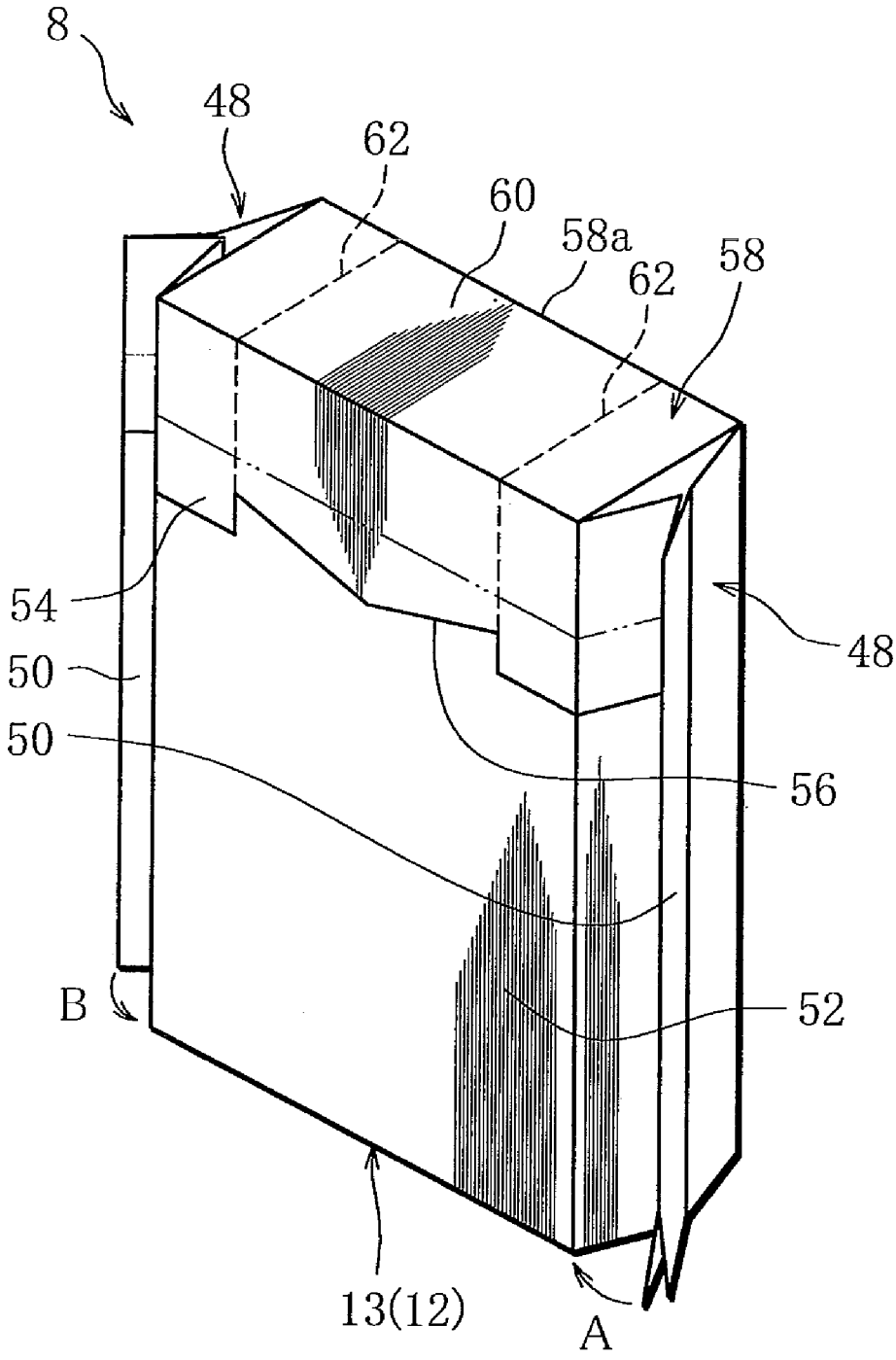
FIG. 4 is a perspective view showing an inner pack to be enclosed in the package of FIG. 1.

As shown in FIG. 4, the inner pack 8 to be enclosed in the box body 4 is cuboidal in shape. The inner pack 8 comprises a bunch of rod-shaped tobacco items 10, and a wrapper 12 covering the bunch. The tobacco items 10 are, for example twenty of filtered cigarettes 85 mm long.

The wrapper 12 for the inner pack 8 is rectangular in shape, and folded to enclose the bunch of tobacco items 10, or in other words, folded into an envelope 13 enclosing the bunch airtightly. More specifically, the wrapper 12 is first wrapped around the bunch of tobacco items 10 along the length thereof, where the opposite transverse edges of the wrapper 12 are bonded together in a manner forming a fin seal, on the front side of the bunch, at an upper position, so that a transverse seal 54 of the fin seal structure is formed. The transverse seal 54 extends over the entire width of the wrapper 12. The transverse seal 54 is then folded down to the bottom side of the bunch, thus overlying the front face 52 of the envelope 13, as seen in FIG. 4.

At the stage that the transverse seal 54 has been formed, the wrapper 12 shows rectangular portions projecting from the side face of the bunch, respectively. Each rectangular portion is gusset-folded at the top as well as at the bottom, and then folded down to cover the corresponding side face of the bunch, thus forming a side face of the envelope 13. Such folding process produces a fin seal-structured vertical seal 50 at the center of each side face of the envelope 13. Each vertical seal 50 extends over the entire length of the side face of the envelope 13, and thus, of the bunch. Each vertical seal 50 is then folded down, for example to the front face 52 side of the envelope 13 as indicated by arrows A and B in FIG. 4, thus overlying the corresponding side face of the envelope 13, by which the inner pack 8 is completed.

More specifically, with the inner pack 8 enclosed in the box body 4, the transverse seal 54 is located above the lower edge of the cutout 24 and below the open end 22 of the box body 4. The transverse seal 54 extends from one vertical seal 50 to the other 50, across the width of the inner pack 8, and thus overlaps the vertical seals 50 at the opposite ends.

A cutout of a flatten M-like shape is formed in the distal edge of the transverse seal 54, in the center. The cutout provides a V-shaped flap 56 in the transverse seal 54. The edge of the V-shaped flap 56 is in agreement with the lower edge of the cutout 24, and thus, the lower edge of the aforementioned to-be-separated section.

The envelope 13 has a to-be-separated section 60 continuing from the V-shaped flap 56. The to-be-separated section 60 is a strip-like section extending from the rear edge 58*a* of the top face 58 of the envelope 13 into the front face 52, delimited by a pair of vertical separation lines 62 and a transverse separation line. More specifically, the vertical separation lines 62 each extend from the corresponding end of the V-shaped flap 56 upward, then across the top face 58 to the rear edge 58*a*. The transverse separation line, not shown in FIG. 4, extends between the paired vertical separation lines 62, along the proximal edge of the transverse seal 54, over the width of the V-shaped flap 56. The width of the to-be-separated section 60, or distance between the paired vertical separation lines 62 is approximately equal to the width of the cutout 24.

The paired vertical separation lines 62 and the transverse separation line are provided on the wrapper 12 as fragile lines. It is not desirable to provide the vertical separation lines 62 and transverse separation line as perforation lines, since perforation lines may damage the airtightness of the inner pack 8.

Figure 5:
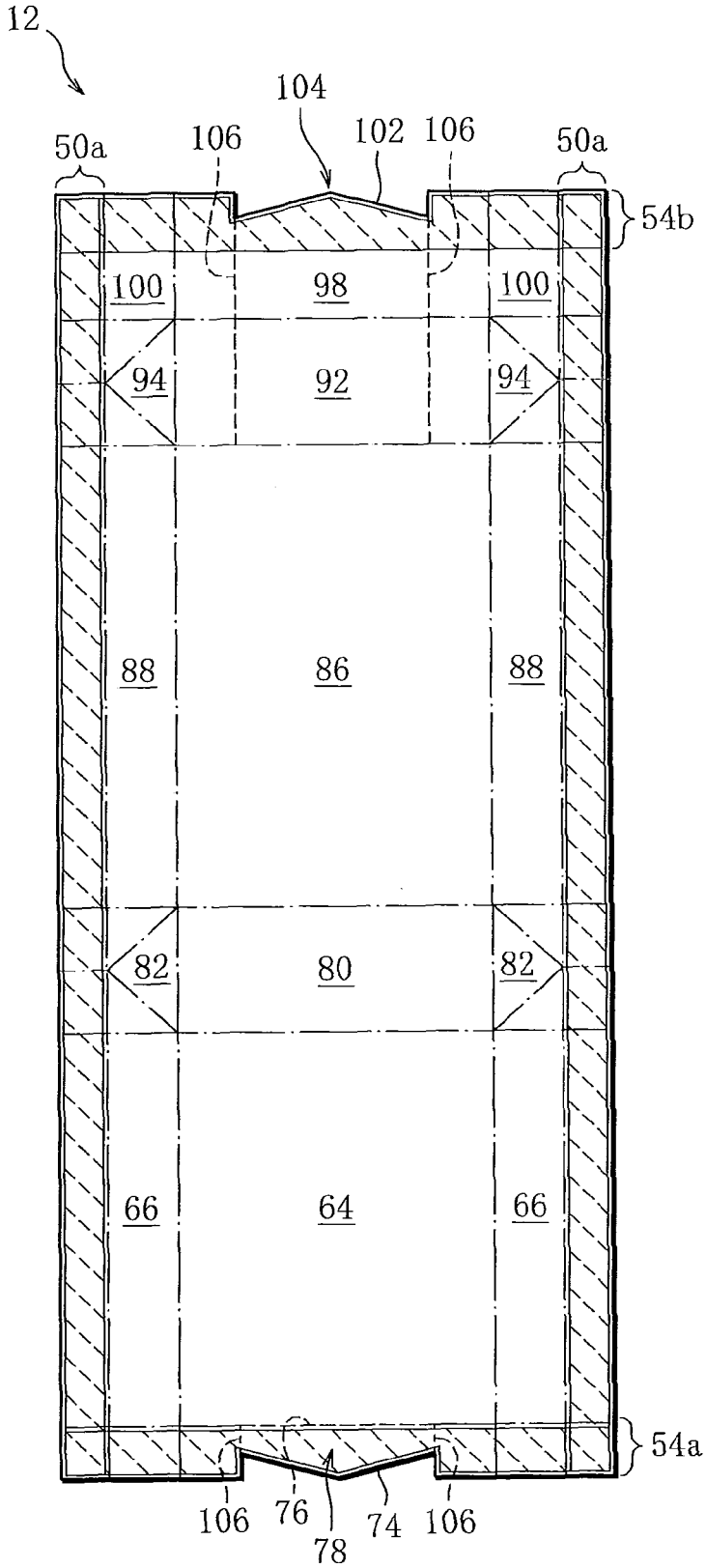
FIG. 5 is a diagram showing a wrapper for forming the inner pack of FIG. 4.

FIG. 5 shows the inner side of the wrapper 12 folded out. In FIG. 5, chain lines represent creases produced on the wrapper 12 by wrapping the bunch of tobacco items 10 in the wrapper 12. It is clear from this drawing what section of the wrapper 12 delimited by creases forms what part of the envelope 13. The wrapper 12 has a heat-seal coating formed of a heat-sealable film all over the inner surface. The provision of the heat-seal coating makes it possible to form the aforementioned transverse seal 54 and vertical seals 50.

More specifically, the wrapper 12 includes a lower front section 64, a bottom section 80, a rear section 86, a top section 92 and an upper front section 98 arranged in line, from the bottom to the top in FIG. 5. The lower front section 64 forms part of the front face 52 of the envelope 13, the bottom section 80 forms the bottom face of the envelope 13, the rear section 86 forms the rear face of the envelope 13, the top section 92 forms the top face 58 of the envelope 13, and the upper front section 98 forms the rest of the front face 52 of the envelope 13. The wrapper 12 further includes, to the left and right sides of the sections 64, 80, 86, 92 and 98, side sections 66, 82, 88, 94, 100 to form the side faces 48 of the envelope 13.

As clear from the above description, a lower edge section 54*a*, extending along the lower edge of the lower front section 64 and side sections 66, and an upper edge section 54*b*, extending along the upper edge of the upper front section 98 and side sections 100, are bonded together by heat-sealing to form the transverse seal 54. Lateral edge sections 50*a*, 50*a*, extending along the left-hand edge of the left-hand side sections 66, 82, 88, 94 and 100 and the right-hand edge of the right-hand side sections 66, 82, 88, 94 and 100, respectively, are each folded and bonded to itself by heat-sealing to form the vertical seals 50, 50, where each vertical seal 50 includes the corresponding end portion of the transverse seal 54.

As clear from FIG. 5, cutouts 74, 102 are formed in the lower edge of the lower front section 64 and the upper edge of the upper front section 98 to provide the aforementioned V-shaped flap 56, and as the aforementioned transverse separation line and vertical separation lines 62 delimiting the to-be-separated section 60, fragile lines 76, 106 are formed on the lower front section 64, upper front section 98 and top section 92.

Chain lines in the side sections 82, 94 represent creases produced on the side sections 82, 94 by the aforementioned gusset-folding.

Figure 6:
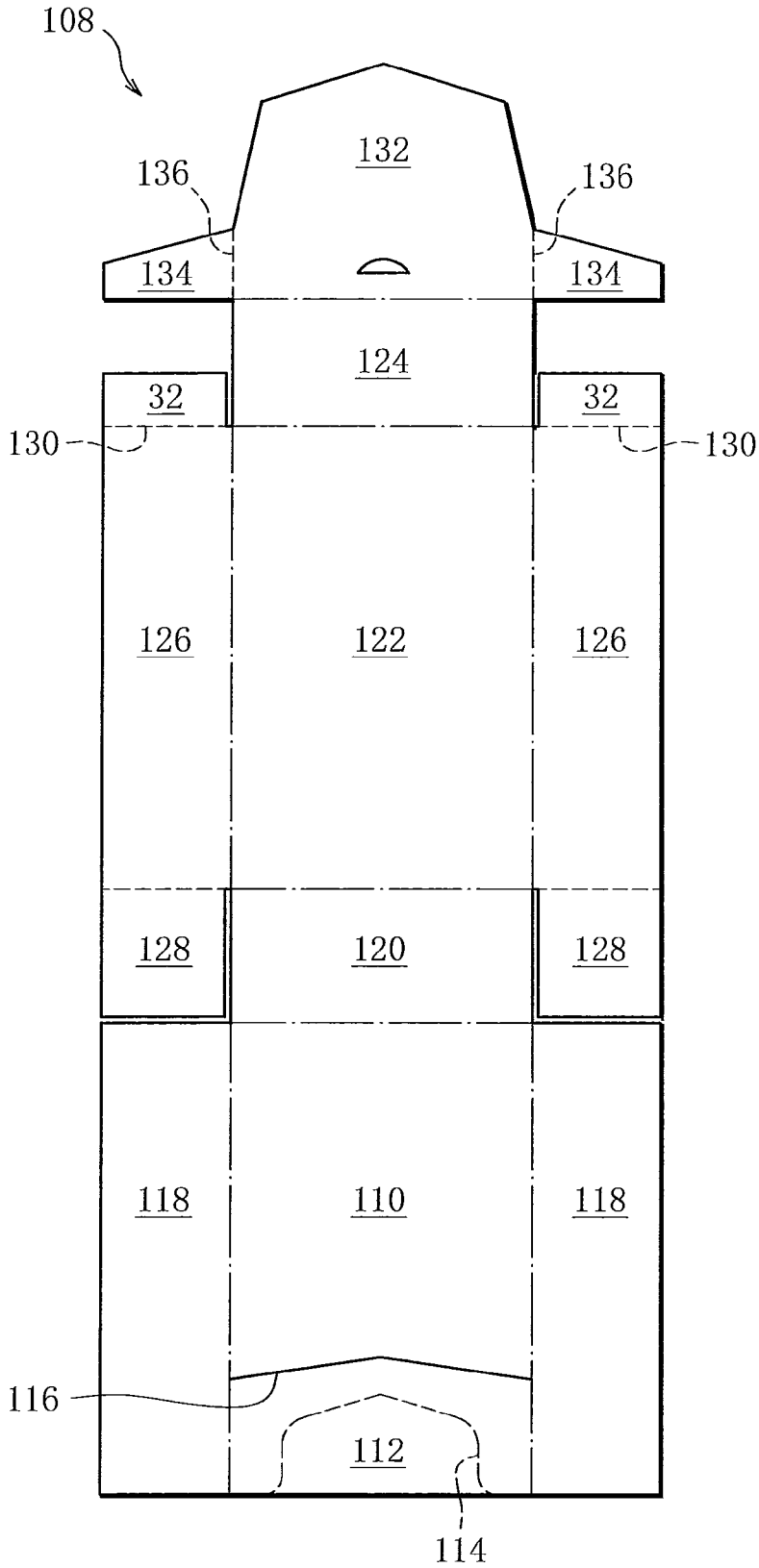
FIG. 6 is a diagram showing a main blank for forming the package of FIG. 1.

FIG. 6 shows a main blank 108 from which to form the box body 4 and tongue-lid 6.

The main blank 108 includes a front panel 110 to form the front wall 14 of the box body 4. The front panel 110 includes a to-be-separated section 112 of the box body 4 at the bottom. The to-be-separated section 112 is delimited by a separation line 114 represented by a dashed line in FIG. 6. Above the to-be-separated section 112, a cut 116 is made to provide the aforementioned slit 26.

Outer side flaps 118 are connected to the lateral edges of the front panel 110 to each provide an outer layer constituting the side wall 18 of the box body 4, and a bottom panel 120 is connected to the upper edge of the front panel 110 to form the bottom wall 20 of the box body 4.

A rear panel 122 is connected to the edge of the bottom panel 120 opposite the edge to which the front panel 110 is connected, to form the rear wall 16.

A lid panel 124 is connected to the edge of the rear panel 122 opposite the edge to which the bottom panel 120 is connected, to form the lid 5. Inner side flaps 126, 126 are connected to the lateral edges of the rear panel 122 to each provide an inner layer constituting the side wall 18 of the box body 4. Inner bottom flaps 128, 128 are connected to the lower edges of the inner side flaps 126 to be located on either side of the bottom panel 120. The inner bottom flaps 128 are to overlie the bottom panel 120 to reinforce the bottom wall 120. Inner top flaps 32 are connected to the upper edges of the inner side flaps 126 by separation lines 130 represented by dashed lines in FIG. 6 to be located on either side of the lid panel 124.

A tongue panel 132 is connected to the upper edge of the lid panel 124 to form the tongue 7. Reinforcement panels 134, 134 are connected to the lateral edges of the tongue panel 132 by separation lines 136 represented by dashed lines in FIG. 6 to form the reinforcement members 40.

In the present embodiment, the main blank 108 is made of paper that weighs 180 to 270 g/m$^2$ and measures 0.2 to 0.5 mm thick. Specifically, the main blank 108 may be made of cardboard, Manila paper or the like.

The above-described main blank 108 is folded along the folding lines represented by chain lines in FIG. 6 to form the box body 4 and the tongue-lid 6, or in other words, the package 2 with the tongue-lid 6 in a closed position as shown in FIG. 1.

More specifically, the aforementioned inner pack 8 is placed over the rear panel 122, then the inner side flaps 126, the inner bottom flaps 128, the inner top flaps 32 and the bottom panel 120 are folded over the inner pack 8, and then the inner bottom flaps 128 are bonded to the bottom panel 120. Then, the front panel 110 is folded over the inner pack 8, then the outer side flaps 118 are folded over and bonded to the inner side flaps 126, respectively.

Here, the V-shaped flap 56 of the inner pack 8 is bonded to the inner surface of the to-be-separated section 112. The inner pack 8 may be bonded to the front panel 110, the rear panel 122, the bottom panel 120, the inner side flaps 126 and/or the like if needed. Then, the lid panel 124, the tongue panel 132 and the reinforcement panels 134 are folded, and then the lid panel 124 is bonded to the inner top flaps 32. Further, the inner surface of the tongue panel 132 is bonded to the outer surface of the to-be-separated section 112, and the reinforcement panels 134 are bonded to the outer side flaps 118, respectively. Thus, the package 2 enclosing the inner pack 8, as shown in FIG. 1, is completed.

The consumer who bought this package 2 first pulls the tongue 7 away from the front wall of the box body 4 by pinching the distal end of the tongue 7. As a result, the to-be-separated section 112 is separated from the box body 4 to produce the cutout 24, the to-be-separated section 60 is separated from the inner pack 8, and at the same time, the reinforcement members 40 are separated from the tongue 7 and the inner top flaps 32 are separated from the box body. As seen in FIG. 2, the tongue-lid 6 opened in this manner allows tobacco items 10 to be exposed in an access opening 63 resulting from separation of the to-be-separated section 60. The consumer removes tobacco items 10 through the access opening 63. The separation piece 28 and the separation flap 60*a* resulting from the separation of the to-be-separated section 112 and the to-be-separated section 60 are held on the inner surface of the tongue-lid 6 (see FIG. 2).

The box body is closed with the tongue-lid 6, by placing the lid 5 over the open end 22 and inserting the insertion end section 38, or distal end section of the tongue 7 into the slit 26. The lid 5 is thus kept in the closed position. The insertion end section 38 is easily inserted into the slit 26, because the insertion end section 38 tapers and because the hinge 44 directs the insertion end section 38 toward the box body 4.

In order to remove tobacco items 10 after closing the box body once, the consumer can bring the lid 5 into the open position by putting a finger tip to the recess 42 in the outer surface of the tongue 7 and pulling the insertion end section 38, or distal end section of the tongue 7 out of the slit 26.

As stated above, in the tongue-lid package 2 according to an embodiment of the present invention, the wrapper 12 for the inner pack 8 has a heat-sealable film all over the inner surface, and such wrapper 12 is formed into the envelope 13 with the edges joined together to form the transverse seal 54 and the vertical seals 50 on either side. Consequently, the inner pack 8 has high airtightness, and the package 2 therefore allows omission of film wrapping.

When the tongue-lid 6 is first opened, the inner top flaps 32 and the reinforcement members 40 are separated along the separation lines, which leaves rough edges on the inner top flaps 32 and the reinforcement members 40, and thus, makes it evident that the tongue-lid 6 has been opened. This is effective to deter tampering.

The separation piece 28 and the separation flap 60*a*, separated from the front wall 14 of the box body and the inner pack 8 when the tongue-lid 6 is first opened, are thereafter kept bonded to the inner surface of the tongue-lid 6, which obviates the need to dispose of the separation piece 28 and the separation flap 60*a*, separately from the package 2.

The fin seal-structured transverse seal 54 and vertical seals 50 are superior, compared with the seal structure where the inner surface of the wrapper is joined to the outer surface thereof, since the fin seal structure alleviates thermal influence on the article inside when seals are formed by heat-sealing.

The transverse seal 54 and vertical seals 50 may be formed by bonding the edges of the wrapper using an adhesive.

The present invention is not restricted to the above-described embodiment but can be altered in various ways. For example, although the package in the described embodiment holds an inner pack containing twenty of tobacco items 85 mm long, the present invention is applicable to the package for holding an inner pack containing twenty of tobacco items approximately 95 mm long. The article to be held in the package is not restricted to tobacco items but can be other items such as sweets. The present invention is applicable to tongue-lid packages for such articles.

EXPLANATION OF REFERENCE CHARACTERS

2: Package
4: Box body
5: Lid
6: Tongue-lid
7: Tongue
8: Inner pack
10: Tobacco item
12: Wrapper
13: Envelope
14: Front wall
22: Open end
24: Cutout
26: Slit
30: Lid hinge
34: Tongue hinge
36: Tongue section
38: Insertion end section
44: Hinge
50: Vertical seal
54: Transverse seal
60*a*: Separation flap
63: Access opening

The invention claimed is:

1. A tongue-lid package, comprising:

a cuboidal box body with an open end at the top, a tongue-lid rotatably connected to a rear edge of the open end by a lid hinge, the tongue-lid including a lid adapted to close the open end and a tongue connected to a distal end of the lid by a tongue hinge, and arranged such that the tongue overlies a front wall of the box body when the lid is in position to close the open end, and a cuboidal inner pack enclosed in the box body, wherein the inner pack includes an article, and an envelope formed by folding a wrapper to enclose the article, the envelope having seams formed by joining edges of the wrapper together to keep the inner pack airtight;

the seams include a transverse seam formed by joining upper and lower edges of the wrapper together, the transverse seam extending across the width of the inner pack on a front or rear face of the inner pack, and a pair of vertical seams each formed by folding and joining a lateral edge of the wrapper to itself, the vertical seams extending on opposite side faces of the inner pack, respectively;

the upper and lower edge sections of the transverse seam of the inner pack are joined and bonded together inclusive of distal edges thereof, and triangular sections formed during gusset folding of the wrapper are folded inward of the inner pack;

the inner pack further includes a to-be-separated section that forms an access opening for exposing the article when the tongue-lid is opened for the first time; and the to-be-separated section is delimited by vertical separation lines made of a pair of fragile lines extending parallel to each other from an upper position on the front face of the inner pack across a top face of the inner pack up to a rear edge of the top face, adjacent to said lid hinge; a transverse separation line made of a fragile line extending between first ends of the vertical separation lines located in the front face of the inner pack; and the rear edge of the top face, which is located between second ends of the vertical separation lines, the rear edge including no fragile line, the to-be-separated section being bonded to an inner surface of the tongue-lid.

2. The tongue-lid package according to claim 1, wherein the transverse seam and the vertical seams are each in the form of a fin seal.

3. The tongue-lid package according to claim 2, wherein the transverse seam and the vertical seams are seams formed by heat-sealing.

4. The tongue-lid package of claim 1, wherein lateral side portions of the package, on each side of the inner pack, are gusset-folded to form triangular sections which are folded inward of the inner pack.

* * * * *